US009557700B2

(12) United States Patent
Kunimori

(10) Patent No.: US 9,557,700 B2
(45) Date of Patent: Jan. 31, 2017

(54) IMAGE FORMATION APPARATUS, IMAGE PROCESSING APPARATUS, AND IMAGE FORMATION METHOD

(71) Applicant: Oki Data Corporation, Tokyo (JP)

(72) Inventor: Osamu Kunimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/972,178

(22) Filed: Dec. 17, 2015

(65) Prior Publication Data

US 2016/0282781 A1 Sep. 29, 2016

(30) Foreign Application Priority Data

Mar. 26, 2015 (JP) ..... 2015-064033

(51) Int. Cl.
*G03G 15/00* (2006.01)

(52) U.S. Cl.
CPC ..... *G03G 15/556* (2013.01)

(58) Field of Classification Search
CPC ..... G03G 15/556; G03G 2215/0429
See application file for complete search history.

(56) References Cited

U.S. PATENT DOCUMENTS

2007/0248369 A1* 10/2007 Izumi ..... G03G 15/1675 399/44
2013/0251431 A1* 9/2013 Numao ..... G03G 15/6585 399/341

FOREIGN PATENT DOCUMENTS

JP 2014-106413 A 6/2014

* cited by examiner

*Primary Examiner* — Sandra Brase
(74) *Attorney, Agent, or Firm* — Mots Law, PLLC

(57) ABSTRACT

An image formation apparatus includes: a calculation section which calculates, based on print data, a distribution of a developer density that is a developer quantity per unit region to be transferred to a transfer object in an image formation; a correction section which performs a correction of the print data according to the distribution of the developer density calculated by the calculation section to additionally transfer a low chroma developer image to the transfer object in the image formation together with a developer image to be formed based on the print data, chroma of the low chroma developer image being lower than chroma of the developer image based on the print data; and an image formation section which performs the image formation based on the print data after the correction performed by the correction section.

16 Claims, 10 Drawing Sheets

Fig. 4

T1

| TYPE OF PRINT MEDIA (media) | PRINT MODE (mode) | PRINT ENVIRON-MENT (EV) | TONER MAXIMUM DENSITY (%) (NUMBER OF TONER COLORS) | | |
|---|---|---|---|---|---|
| | | | 100 (1) | 200 (2) | 300 (3) |
| PLAIN PAPER | SINGLE-SIDED | LL | 4. 0KV | 4. 1KV | 4. 3KV |
| | | NN | 3. 8KV | 3. 9KV | 4. 0KV |
| | DOUBLE-SIDED | LL | 4. 5KV | 4. 6KV | 4. 7KV |
| | | NN | 4. 3KV | 4. 4KV | 4. 5KV |
| FILM | SINGLE-SIDED | LL | 4. 6KV | 4. 7KV | 4. 8KV |
| | | NN | 4. 1KV | 4. 2KV | 4. 3KV |

V2

Fig. 5

T2

| TYPE OF PRINT MEDIA (media) | PRINT MODE (mode) | PRINT ENVIRON-MENT (EV) | TONER MAXIMUM DENSITY (%) (NUMBER OF TONER COLORS) | | |
|---|---|---|---|---|---|
| | | | 100 (1) | 200 (2) | 300 (3) |
| PLAIN PAPER | SINGLE-SIDED | LL | 0% | 0% | 100% |
| | | NN | 0% | 0% | 0% |
| | DOUBLE-SIDED | LL | 0% | 100% | 200% |
| | | NN | 0% | 0% | 100% |
| FILM | SINGLE-SIDED | LL | 0% | 150% | 250% |
| | | NN | 0% | 100% | 200% |

ThL
TONER-DENSITY LOWER LIMIT

IMAGE FORMATION APPARATUS, IMAGE PROCESSING APPARATUS, AND IMAGE FORMATION METHOD

CROSS REFERENCE TO RELATED APPLICATIONS

This application claims priority based on 35 USC 119 from prior Japanese Patent Application No. 2015-064033 filed on Mar. 26, 2015, entitled "IMAGE FORMATION APPARATUS, IMAGE PROCESSING APPARATUS, AND IMAGE FORMATION METHOD", the entire contents of which are incorporated herein by reference.

BACKGROUND OF THE INVENTION

1. Field of the Invention

The disclosure relates to an image formation apparatus and an image formation method of forming an image using an electrophotographic system, and to an image processing apparatus applied to such an image formation apparatus.

2. Description of Related Art

In an image formation apparatus using an electrophotographic system, an image formation section forms (transfers) a toner image directly or indirectly onto a recording medium such as paper, and a fixing device (a fuser) fixes the formed toner image onto the medium (see, for example, Japanese Patent Application Publication No. 2014-106413). Image formation using the electrophotographic system is thus performed.

SUMMARY OF THE INVENTION

It is desirable to obtain a favorable image (improve image quality) in an image formation apparatus.

An object of an embodiment of the invention is to obtain a favorable image.

A first aspect of the invention is an image formation apparatus that includes: a calculation section which calculates, based on print data, a distribution of a developer density that is a developer quantity per unit region to be transferred to a transfer object in image formation; a correction section which performs a correction of the print data according to the distribution of the developer density calculated by the calculation section to additionally transfer a low chroma developer image to the transfer object in the image formation, together with a developer image to be formed based on the print data, chroma of the low chroma developer image being lower than chroma of the developer image based on the print data; and an image formation section which performs the image formation based on the print data after the correction performed by the correction section.

A second aspect of the invention is an image processing apparatus that includes: a calculation section which calculates, based on print data, a distribution of a developer density that is a developer quantity per unit region to be transferred to a transfer object in image formation; and a correction section which performs a correction of the print data according to the distribution of the developer density calculated by the calculation section to additionally transfer a low chroma developer image to the transfer object in the image formation together with a developer image to be formed based on the print data, chroma of the low chroma developer image being lower than chroma of the developer image based on the print data.

A third aspect of the invention is an image formation method that includes: calculating, based on print data, a distribution of a developer density that is a developer quantity per unit region to be transferred to a transfer object in image formation; performing a correction of the print data according to the distribution of the developer density calculated to additionally transfer a low chroma developer image to the transfer object in the image formation together with a developer image to be formed based on the print data, chroma of the low chroma developer image being lower than chroma of the developer image based on the print data; and performing the image formation, based on the print data after the correction performed by the correction section.

The above aspects of the invention make it possible to obtain a favorable image.

BRIEF DESCRIPTION OF THE DRAWINGS

FIG. 3 is a diagram illustrating a block configuration example including the image formation apparatus illustrated in FIG. 1, and the like.

FIG. 4 is a schematic diagram illustrating a configuration example of the secondary-transfer voltage setting table illustrated in FIG. 3.

FIG. 5 is a schematic diagram illustrating a configuration example of the toner-density lower limit setting table illustrated in FIG. 3.

DETAILED DESCRIPTION OF EMBODIMENTS

Figure 1:
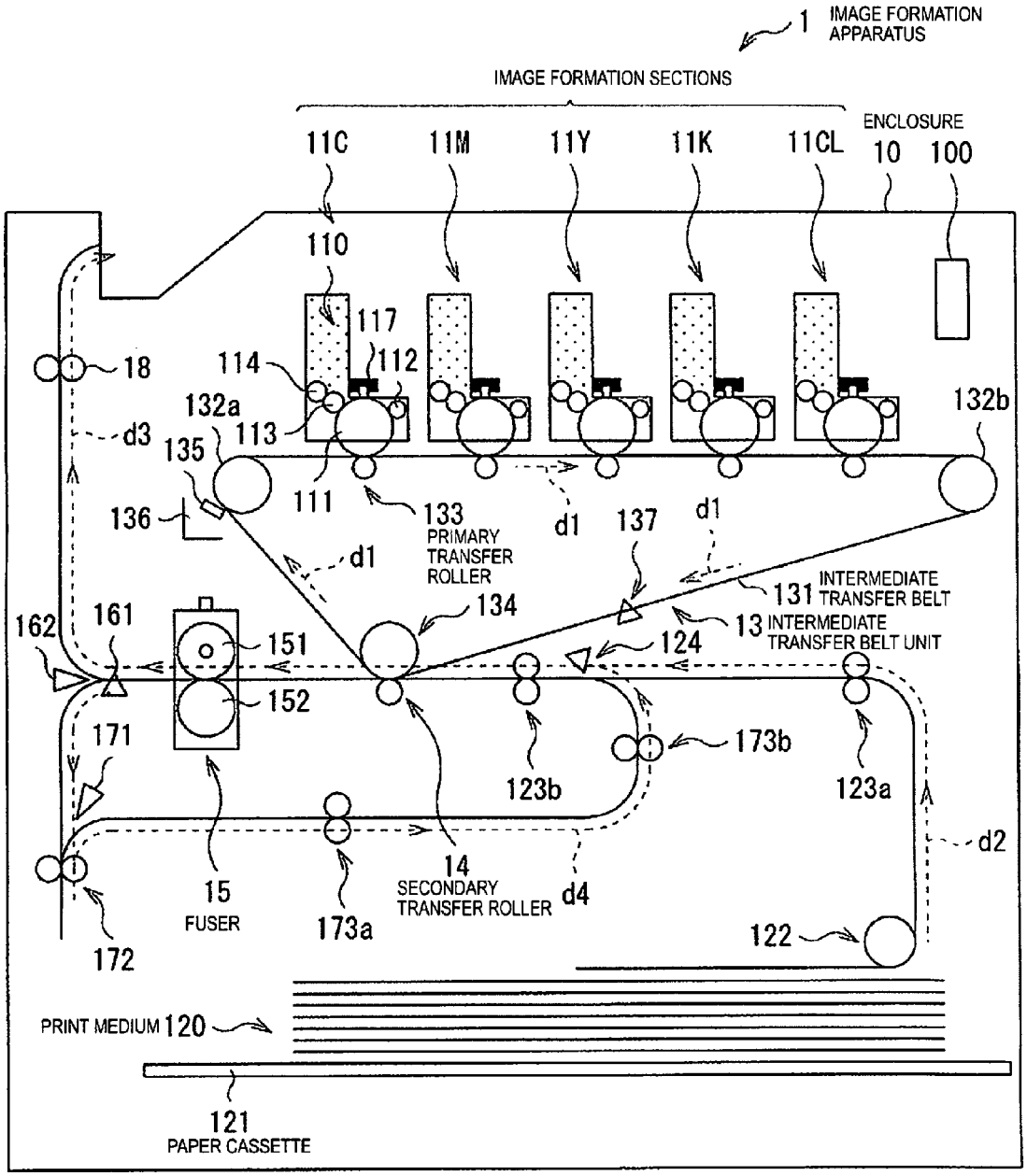
FIG. 1 is a schematic diagram illustrating a schematic configuration example of an image formation apparatus according to an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

The descriptions are provided in the following order.

1. Embodiment (an example of an intermediate-transfer-type image formation apparatus)
2. Modification (an example of a case where an image processing apparatus is provided outside an image formation apparatus)
3. Other modifications

1. Embodiment

Outline of Configuration

FIG. 1 illustrates a schematic configuration example of an image formation apparatus (image formation apparatus 1) according to an embodiment of the invention. Image formation apparatus 1 functions, for example, as a printer (in this example, a color printer) forming an image (in this example, a color image) on print medium 120 made of plain paper or the like, by using an electrophotographic system. Image formation apparatus 1 is a so-called intermediate-transfer-type image formation apparatus, which transfers a toner image to print medium 120 via intermediate transfer belt unit 13, as described later. An image formation method according to the embodiment is embodied in image formation apparatus 1 of the embodiment, and therefore is described below together therewith. Image formation apparatus 1 corresponds to a specific example of "image formation apparatus" in the invention.

Image formation apparatus 1 includes five image formation sections 11C, 11M, 11Y, 11K, and 11CL, environment sensor 100, paper cassette (paper tray) 121, feed roller 122, conveyance roller pairs 123*a* and 123*b*, and paper sensor 124, as illustrated in FIG. 1. This image formation apparatus 1 further includes intermediate transfer belt unit 13, secondary transfer roller 14, fuser (fixing device) 15, paper sensor 161, separator 162, separation piece 171, inversion roller pair 172, conveyance roller pairs 173*a* and 173*b*, and discharge roller pair 18.

As illustrated in FIG. 1, these members are accommodated in designated enclosure 10 having an openable top cover and other parts (not illustrated). Image formation sections 11C, 11M, 11Y, 11K, and 11CL are each integrally configured, and detachably attached to image formation apparatus 1.

Paper cassette 121 is a member provided to contain print media 120 in a stacked state. In the example illustrated in FIG. 1, paper cassette 121 is a built-in tray detachably attached to a lower part in image formation apparatus 1.

Feed roller 122 is a member (a sheet feeder mechanism) provided to extract an uppermost print medium 120 one by one separately from the rest of the paper contained in paper cassette 121 to send it toward conveyance roller pairs 123*a* and 123*b*.

Conveyance roller pairs 123*a* and 123*b* each serve as a pair of members provided to hold print medium 120 sent from feed roller 122 and convey it toward secondary transfer roller 14, correcting an oblique posture of print medium 120 at the same time. In other words, conveyance roller pairs 123*a* and 123*b* are configured to convey print medium 120 along conveyance path (conveyance direction) d2.

Environment sensor 100 is a sensor provided to detect the environment (print environment) in which image formation apparatus 1 is installed. Paper sensor 124 is a sensor provided to detect a conveyance position of print medium 120 on an upstream side of conveyance roller pair 123*b*.

(Image Formation Sections 11C, 11M, 11Y, 11K, and 11CL)

As illustrated in FIG. 1, image formation sections 11C, 11M, 11Y, 11K, and 11CL are disposed to align in conveyance direction (conveyance path) d1 of intermediate transfer belt 131, to be described later. Specifically, image formation sections 11C, 11M, 11Y, 11K, and 11CL are disposed in this order in conveyance direction d1 (from an upstream side toward a downstream side). These image formation sections 11C, 11M, 11Y, 11K, and 11CL correspond to a specific example of an "image formation section" in the invention.

Image formation sections 11C, 11M, 11Y, 11K, and 11CL form respective images (toner images) on intermediate transfer belt 131, to be described later, by using toners (developers) of different colors. Specifically, image formation section 11C forms a cyan-color toner image using a cyan (C: Cyan) toner, image formation section 11M forms a magenta-color toner image by using a magenta (M: Magenta) toner, and image formation section 11Y forms a yellow-color toner image by using a yellow (Y: Yellow) toner. Similarly, image formation section 11K forms a black-color toner image by using a black (K: black) toner, and image formation section 11CL forms a transparent toner image (a clear toner image) serving as an example of a low chroma toner image, by using a clear (CL: clear) toner (a transparent toner) serving as an example of a low chroma toner.

Each of the cyan toner (cyan toner 4C to be described later), the magenta toner (magenta toner 4M to be described later), the yellow toner (yellow toner 4Y to be described later), and the black toner (black toner 4K to be described later) corresponds to a specific example of "developers of colors" in the invention. The cyan-color toner image, the magenta-color toner image, the yellow-color toner image, and the black-color toner image each correspond to a specific example of "developer image formed based on print data" in the invention. The transparent toner corresponds to a specific example of each of a "low chroma developer" and a "transparent developer", and the transparent toner image corresponds to a specific example of each of a "low chroma developer image" and a "transparent developer image" in the invention. Here, "low chroma" refers to a chroma lower than that of the color of a developer used for formation of the original print data (in this example, print data D1), and a "low chroma developer image" refers to a developer image having a chroma lower than that of a developer image formed based on this original print data, which holds true for the following description.

For a coloring agent used for each of the cyan, magenta, yellow, and black toners, one or more kinds of dye or pigment, and the like, may be used alone or in combinations thereof. Specifically, usable examples of such a coloring agent include carbon black, iron oxide, permanent brown FG, pigment green B, pigment blue 15:3, solvent blue 35, solvent red 49, solvent red 146, quinacridone, carmine 6B, naphthol, disazo yellow, and isoindoline.

On the other hand, the clear (transparent) toner is, in general, a toner for which no coloring agent is used.

Here, image formation sections 11C, 11M, 11Y, 11K, and 11CL have the same configuration except for forming toner images (developer images) using the toners of the different colors as described above. Therefore, representing these sections, image formation section 11C is described below.

As illustrated in FIG. 1, image formation section 11C has toner cartridge 110 (a developer container), photosensitive drum 111 (an image carrier), charge roller 112 (a charge member), development roller 113 (a developer carrier), feed roller 114 (a developer feed member), and exposure head 117 (an exposure device).

Toner cartridge 110 is a container containing the above-described toner of each color. In other words, in the example of image formation section 11C, toner cartridge 110 contains the cyan toner. Similarly, toner cartridge 110 in image formation section 11M contains the magenta toner, and toner cartridge 110 in image formation section 11Y contains the yellow toner. Further, toner cartridge 110 in image formation section 11K contains the black toner, and toner cartridge 110 in image formation section 11CL contains the clear toner.

Photosensitive drum 111 is a member provided to carry an electrostatic latent image on the surface (an outer layer part) thereof, and is configured with a photosensitive body (for example, an organic photosensitive body). Specifically, photosensitive drum 111 has a conductive support and a photoconductive layer covering a periphery (a surface) of the conductive support. The conductive support is configured, for example, using a metal pipe made of aluminum. The photoconductive layer has, for example, a structure in which a charge generation layer and a charge transfer layer are laminated in order. Photosensitive drum 111 is configured to rotate at a predetermined circumferential velocity.

Charge roller 112 is a member provided to charge the surface (the outer layer part) of photosensitive drum 111, and is disposed to be contact with the surface (the peripheral surface) of photosensitive drum 111. Charge roller 112 has, for example, a metal shaft and a semiconductive rubber layer (for example, a semiconductive epichlorohydrin rubber layer) covering the periphery (a surface) of the metal shaft. Charge roller 112 is configured, for example, to rotate in the opposite direction of photosensitive drum 111.

Development roller 113 is a member provided to carry the toner on the surface thereof for developing an electrostatic latent image, and is disposed to be in contact with the surface (the peripheral surface) of photosensitive drum 111. Development roller 113 has, for example, a metal shaft, and a semiconductive urethane rubber layer covering the periphery (the surface) of the metal shaft. Development roller 113 is configured, for example, to rotate in the opposite direction of photosensitive drum 111 at a predetermined circumferential velocity.

Feed roller 114 is a member provided to feed the toner contained in toner cartridge 110 to development roller 113, and is disposed to be in contact with the surface (the peripheral surface) of development roller 113. Feed roller 114 has, for example, a metal shaft, and a foaming silicone rubber layer covering the periphery (the surface) of the metal shaft. Feed roller 114 is configured, for example, to rotate in the same direction as development roller 113.

Exposure head 117 is a device provided to form an electrostatic latent image on the surface (the outer layer part) of photosensitive drum 111, by performing an exposure by emitting irradiation light to the surface of photosensitive drum 111. Exposure head 117 is supported by the top cover (not illustrated) of enclosure 10. Exposure head 117 includes, for example, light sources for emitting the irradiation light, and a lens array for forming an image by this irradiation light on the surface of photosensitive drum 111. Examples of each of these light sources include a light emitting diode (LED) and a laser device.

(Intermediate Transfer Belt Unit 13) As illustrated in FIG. 1, intermediate transfer belt unit 13 is a belt unit to which each of the toner images of the colors formed by respective image formation sections 11C, 11M, 11Y, 11K, and 11CL is primarily transferred (intermediately transferred). As described in detail later, the toner image of each color primarily transferred in this way is secondarily transferred from intermediate transfer belt unit 13 to print medium 120 conveyed on conveyance path d2, as illustrated in FIG. 1. The members to be described below in intermediate transfer belt unit 13 are integrally formed (integrated into a single unit).

As illustrated in FIG. 1, intermediate transfer belt unit 13 has intermediate transfer belt 131, belt drive roller (a drive roller) 132*a*, belt tension roller (an idle roller) 132*b*, primary transfer roller 133, backup roller (a secondary transfer counter roller) 134, cleaning blade 135, toner collection container 136, and density sensor 137.

Intermediate transfer belt 131 is a belt having a surface onto which each of the toner images of the colors formed by respective image formation sections 11C, 11M, 11Y, 11K, and 11CL is to be primarily transferred, as described above. In other words, the surface of intermediate transfer belt 131 is configured to temporarily carry such a toner image of each color. As illustrated in FIG. 1, intermediate transfer belt 131 is suspended by belt drive roller 132*a*, belt tension roller 132*b*, and backup roller 134. Intermediate transfer belt 131 is rotated by belt drive roller 132*a* and belt tension roller 132*b*, to move in conveyance direction d1 illustrated in FIG. 1. The toner image of each color thus primarily transferred to the surface of intermediate transfer belt 131 in this manner is then secondarily transferred onto print medium 120, as described later. Intermediate transfer belt 131 corresponds to a specific example of "transfer object" in the invention.

Belt drive roller 132*a* connected to a motor (not illustrated) is configured to rotationally move (circulate) intermediate transfer belt 131 by being rotationally driven by the motor. Belt tension roller 132*b* is configured to hold intermediate transfer belt 131 by providing tension to intermediate transfer belt 131 by using a spring.

Primary transfer roller 133 is a member provided to transfer electrostatically (primarily transfer) the toner image of the color formed by each of image formation sections 11C, 11M, 11Y, 11K, and 11CL, onto intermediate transfer belt 131. As illustrated in FIG. 1, primary transfer roller 133 is disposed to face photosensitive drum 111 in each of image formation sections 11C, 11M, 11Y, 11K, and 11CL, with intermediate transfer belt 131 interposed therebetween. Primary transfer roller 133 is made of, for example, a foaming semiconductive elastic rubber material.

As illustrated in FIG. 1, backup roller 134 is disposed to face secondary transfer roller 14 to be described later. Backup roller 134 is a member provided to secondarily transfer the toner image of each color primarily transferred onto intermediate transfer belt 131, onto print medium 120 in cooperation with secondary transfer roller 14.

As illustrated in FIG. 1, cleaning blade 135 is disposed at a position facing belt drive roller 132*a* with intermediate transfer belt 131 interposed therebetween. Cleaning blade 135 is a member provided to remove (clean) the toner remaining on the surface of intermediate transfer belt 131 (residual toner) from the surface after the toner image of each color is secondarily transferred onto print medium 120. Cleaning blade 135 is configured with, for example, an elastic body made of a material such as polyurethane rubber. Toner collection container 136 is a container provided to collect and store the residual toner removed by cleaning blade 135.

Density sensor 137 is a sensor provided to measure the quantity (a primary transfer toner quantity) of the toner primarily transferred onto intermediate transfer belt 131.

(Secondary Transfer Roller 14)

Secondary transfer roller 14, disposed to face backup roller 134 described above, is a member provided to transfer electrostatically (secondarily transfer) the toner image of each color primarily transferred onto intermediate transfer belt 131, onto print medium 120 in cooperation with backup roller 134. Secondary transfer roller 14 is made of, for example, a foaming semiconductive elastic rubber material.

Figure 2:
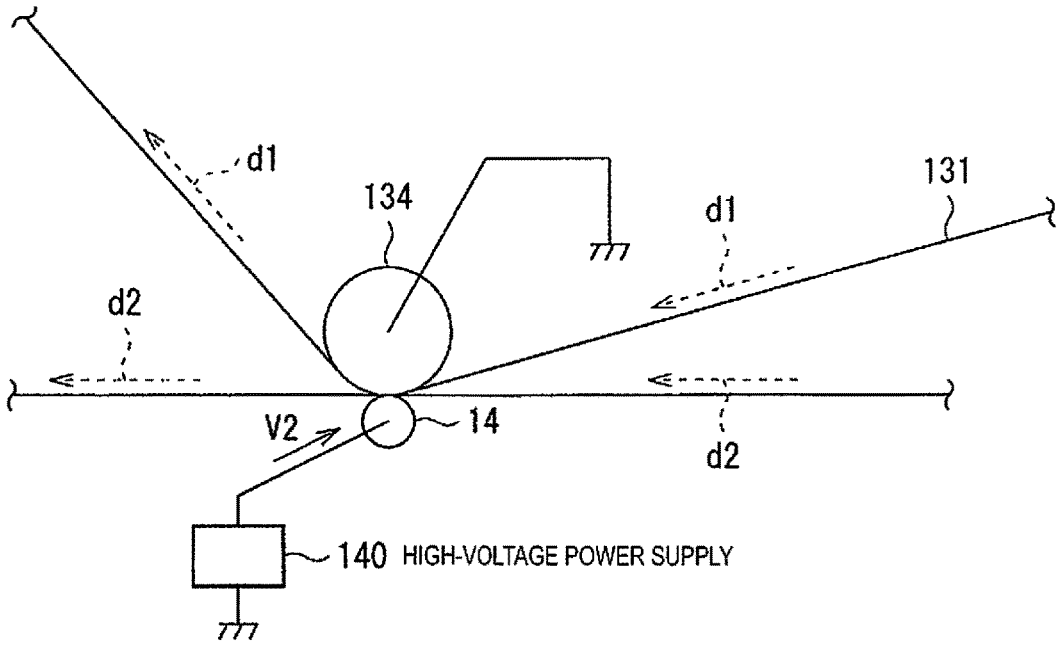
FIG. 2 is a schematic diagram illustrating a detailed configuration example of a part including a secondary transfer roller illustrated in FIG. 1 and the vicinity thereof.

Here, for example, as illustrated in FIG. 2, while secondary transfer roller 14 is supplied with a positive potential (secondary transfer voltage V2) by high-voltage power supply 140, a shaft of backup roller 134 described above is grounded to image formation apparatus 1. Therefore, an electric field is supplied to intermediate transfer belt 131 (in conveyance direction d1) and print medium 120 (on conveyance path d2) conveyed between secondary transfer roller 14 and backup roller 134, so that an electric current (a secondary transfer electric current) flows.

(Fuser 15)

Fuser 15 illustrated in FIG. 1 is a device provided to fix the toner (the toner image) on print medium 120 conveyed along conveyance path d2 after being secondarily transferred as described above, by applying heat and pressure to the toner. As illustrated in FIG. 1, fuser 15 includes heat roller 151 and pressure roller 152 disposed to face each other with conveyance path d2 for print medium 120 interposed therebetween. Fuser 15 is, for example, integrated with image formation apparatus 1 or detachably attached to image formation apparatus 1.

Paper sensor 161 is a sensor provided to detect a conveyance position of print medium 120 on a downstream side of fuser 15. Further, as illustrated in FIG. 1, separator 162 is a member provided to switch a conveyance path for print medium 120 conveyed on conveyance path d2, between conveyance path d3 tending toward discharge roller pair 18 to be described later and conveyance path d4 tending toward inversion roller pair 172 to be described later.

Separation piece 171 and inversion roller pair 172 are members provided to reverse (to reverse the positions of the front side and the back side of) print medium 120 conveyed to conveyance path d4 after switching by separator 162. Conveyance roller pairs 173*a* and 173*b* are each provided as a pair of members to convey thus-reversed print medium 120 along conveyance path d4 toward conveyance path d2 again (at an upstream position of paper sensor 124).

Discharge roller pair 18 is a pair of members provided to eject print medium 120, conveyed on the conveyance path d3 selected by separator 162, to the outside. Specifically in this example, as illustrated in FIG. 1, print medium 120 is ejected toward on the top cover (not illustrated) of enclosure 10 with its face down.

[Configurations of the Control System and Others]

Figure 3:
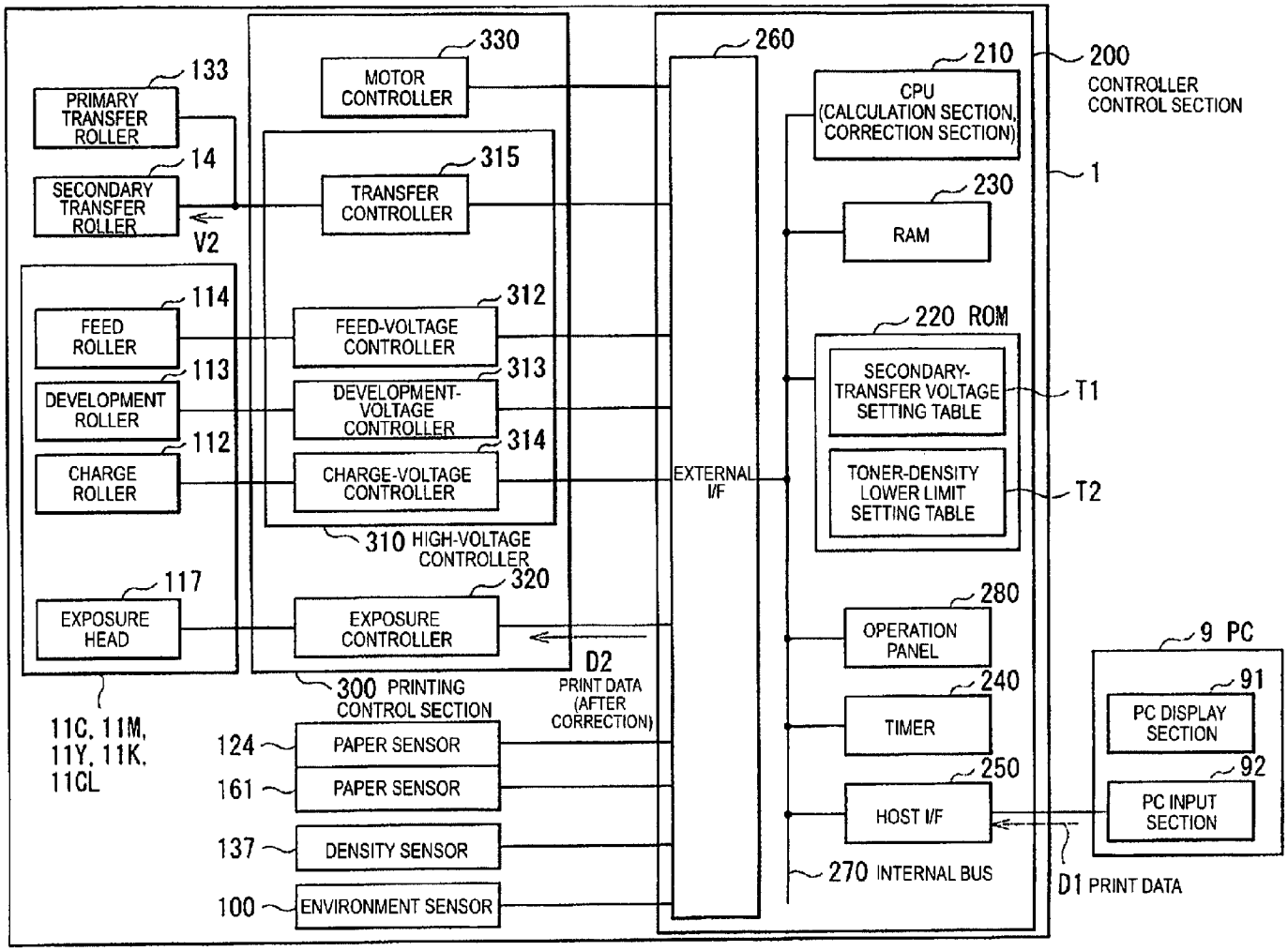

Here, a control system of image formation apparatus 1 is described with reference to FIGS. 3 to 6 in addition to FIGS. 1 and 2. FIG. 3 illustrates an example of the control system of image formation apparatus 1 in a block diagram with controlled objects and an external device to be described later.

As illustrated in FIG. 3, in this example, the control system of image formation apparatus 1 includes controller control section 200 and printing control section 300. In this example, personal computer (PC) 9 is provided as an external device that supplies print data D1 to image formation apparatus 1.

(PC 9)

As illustrated in FIG. 3, PC 9 has PC display section 91 and PC input section 92 as well as a central processing unit (CPU), a read only memory (ROM), and a random access memory (RAM), which are not illustrated. PC 9 is a device provided to generate print data D1 and supply the print data to image formation apparatus 1.

PC display section 91 configured with, for example, a liquid crystal display (LCD) and other components displays various kinds of information. PC input section 92 configured with, for example, a keyboard, a switch, a mouse, and other components is a part in which various kinds of information are inputted by the user's operation.

(Controller Control Section 200)

As illustrated in FIG. 3, controller control section 200 has CPU 210, ROM 220, RAM 230, timer 240, host interface (I/F) 250, external I/F 260, internal bus 270, and operation panel 280.

CPU 210 is a part provided to perform processing such as various kinds of arithmetic processing and control processing. Specifically, CPU 210 has functions such as a calculation function (a derivation function) of determining a toner density distribution (toner density distribution M to be described later) and a correction function of correcting print data D1. In other words, CPU 210 corresponds to a specific example of each of "calculation section", "correction section", and "image processing apparatus" in the invention.

First, based on supplied print data D1, CPU 210 calculates a distribution (a toner density distribution) of a toner density (toner density Dt to be described later), which is a toner quantity per unit region (unit area) to be transferred (primarily transferred) onto intermediate transfer belt 131 in the image formation. Specifically, in this example, CPU 210 is configured to calculate the toner density distribution by determining a toner density for each pixel serving as the unit region.

According to the toner density distribution thus calculated, CPU 210 corrects print data D1 such that, together with the toner image of each color to be formed based on print data D1, the above-described low chroma toner image is additionally transferred (primarily transferred) to intermediate transfer belt 131 in the image formation. To be more specific, in this example, print data D1 is corrected, such that, in addition to the toner images (original toner images) of the colors (cyan, magenta, yellow, and black) to be formed by respective image formation sections 11C, 11M, 11Y, and 11K, the above-described transparent toner image to be formed by image formation section 11CL is additionally primarily transferred. In other words, based on the calculated toner density distribution, CPU 210 creates print data to form such a transparent toner image. Print data D2 resulting from such a correction is supplied to printing control section 300 to be described later, as illustrated in FIG. 3, and each of image formation sections 11C, 11M, 11Y, 11K, and 11CL performs image formation for print medium 120 based on print data D2.

Figure 9:
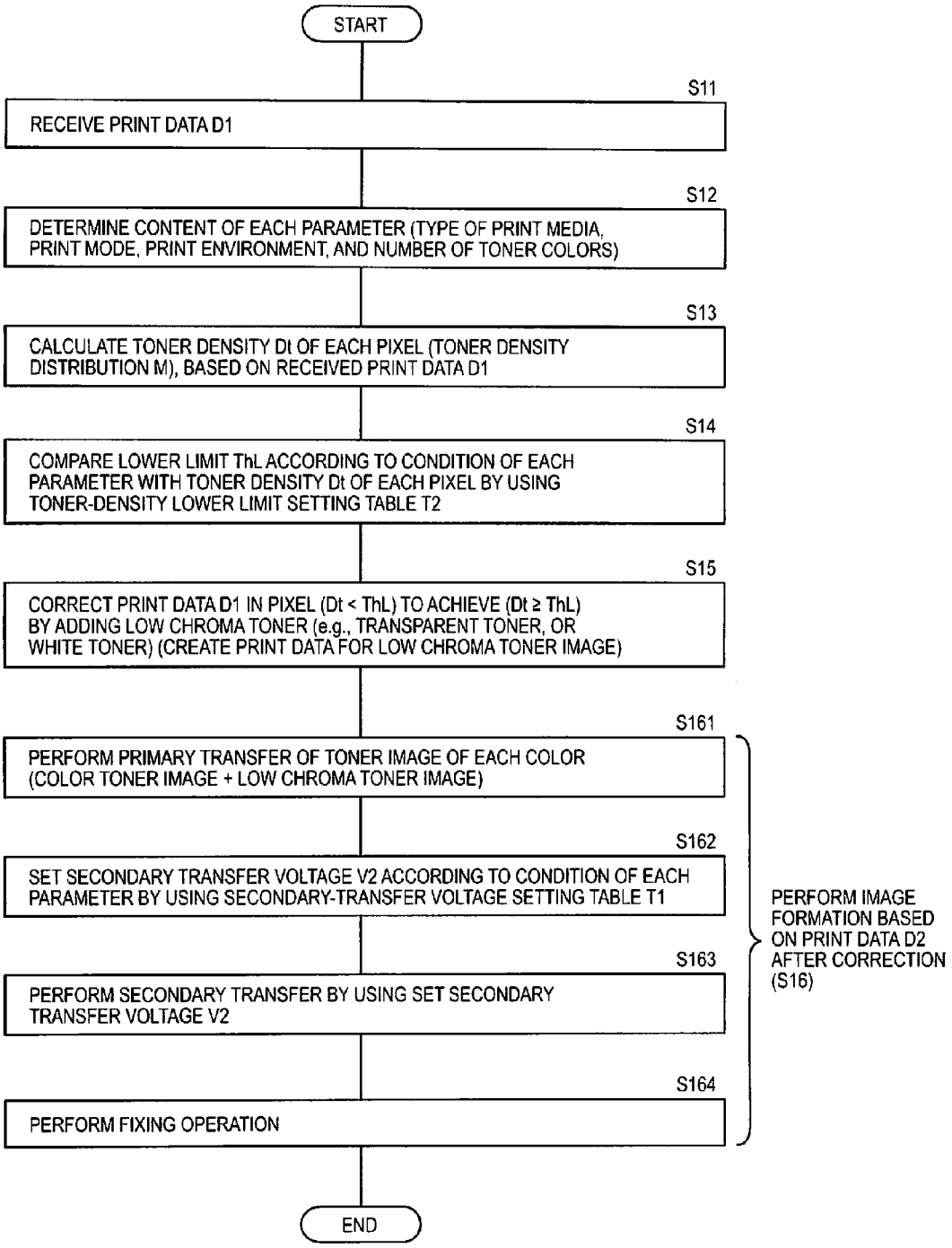
FIG. 9 is a flowchart illustrating an example of an image formation operation according to the embodiment.
Figure 10:
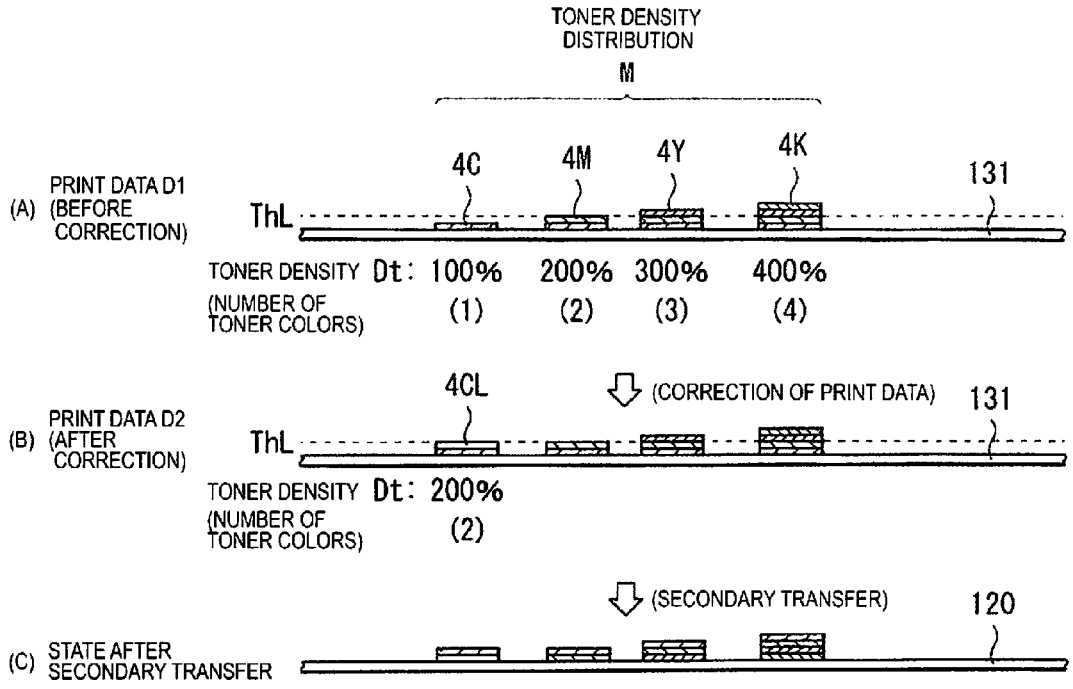
FIG. 10 is a schematic cross-sectional diagram for describing the image formation operation illustrated in FIG. 9.

Details of the calculation function (the derivation function) of determining the toner density distribution and the correction function of correcting print data D1 in CPU 210 are described later (FIG. 9, FIG. 10, and other figures).

ROM 220 is a storage section provided to store various data. Specifically, in this example, ROM 220 stores (holds), in addition to an operation program of CPU 210, secondary-transfer voltage setting table T1 and toner-density lower limit setting table T2 that are described below.

FIG. 4 schematically illustrates an example of secondary-transfer voltage setting table T1, and FIG. 5 schematically illustrates an example of toner-density lower limit setting table T2. Toner-density lower limit setting table T2 corresponds to a specific example of a "table" in the invention.

Secondary-transfer voltage setting table T1 illustrated in FIG. 4 defines a correlation between secondary transfer voltage V2 and various parameters (in this example, parameters including a type of print media (media), a print mode (mode), a print environment (EV), and the number of toner colors used in image formation). In other words, in this example, secondary transfer voltage V2 is a variable value that varies (is changeable) according to the various parameters. Note that the use of at least only one of these parameters may be adopted.

Here, in this example, plain paper and film are listed as the type of print media. A single-sided printing mode and a double-sided printing mode are listed as the print mode. As the print environment, "LL" (an environment with a low temperature and a low humidity (low-temperature low-humidity)) and "NN" (a normal environment with a normal temperature and a normal humidity) are listed. As the number of toner colors, three types, which are one color, two colors, and three colors, are listed.

Note that "toner maximum density" corresponding to the number of toner colors illustrated in FIGS. 4 and 5 refers to a maximum [%] of the toner density of each color, after a toner density correction (exposure control to achieve a toner layer thickness target) to be described later is performed before the printing operation. In other words, the toner maximum density=100% corresponds to a maximum toner density when the image formation is performed using the toner of one color. Similarly, the toner maximum density=200% corresponds to a maximum toner density when the image formation is performed using the toners of two colors, and the toner maximum density=300% corresponds to a maximum toner density when the image formation is performed using the toners of three colors.

In the example of secondary-transfer voltage setting table T1 illustrated in FIG. 4, secondary transfer voltage V2 for the film is greater than that for the plain paper in the type of print media. As for the print mode, secondary transfer voltage V2 for the double-sided printing mode is greater than that for the single-sided printing mode. As for the print environment, secondary transfer voltage V2 for the low-temperature low-humidity environment (LL) is greater than that for the normal environment (NN). As the number of toner colors (toner maximum density) increases, secondary transfer voltage V2 also increases.

Toner-density lower limit setting table T2 illustrated in FIG. 5 defines a correlation between toner-density lower limit ThL to be described later and various parameters (in this example, parameters including the type of print media (media), the print mode (mode), the print environment (EV), and the number of toner colors used in image formation) likewise. In other words, in this example, toner-density lower limit ThL is a variable value that varies (is changeable) according to the various parameters. Use of at least only one of these parameters may be adopted.

Here, in this example, as in the example of secondary-transfer voltage setting table T1 described above, the plain paper and the film are listed as the type of print media. The single-sided printing mode and the double-sided printing mode are each listed as the print mode. As the print environment, "LL" (the low-temperature low-humidity environment) and "NN" (the above-described normal environment) are each listed. As the number of toner colors (the above-described toner maximum density), three types, which are one color (100%), two colors (200%), and three colors (300%), are listed.

In this example of toner-density lower limit setting table T2 illustrated in FIG. 5, toner-density lower limit ThL for the film is greater than that for the plain paper in the type of print media. As for the print mode, toner-density lower limit ThL for the double-sided printing mode is greater than that for the single-sided printing mode. As for the print environment, Toner-density lower limit ThL for the low-temperature low-humidity environment (LL) is greater than that for the normal environment (NN). As the number of toner colors (the toner maximum density) increases, toner-density lower limit ThL also increases.

Figure 6:
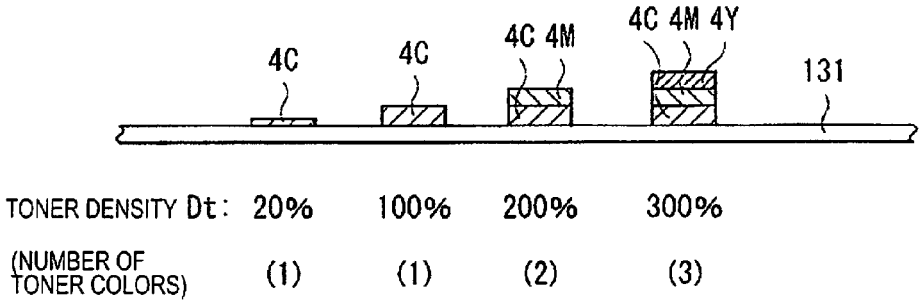
FIG. 6 is a schematic cross-sectional diagram for describing a specific example of a toner density.

Here, a specific example of the toner density (toner density Dt) in each pixel is described with reference to FIG. 6. In this example, at the leftmost pixel, only the toner image of one color that is the cyan toner 4C is primarily transferred onto intermediate transfer belt 131, and the toner quantity is toner density Dt=20%. At the second pixel from left, similarly, only the toner image of one color that is the cyan toner 4C is primarily transferred onto intermediate transfer belt 131, and the toner quantity is toner density Dt=100%. At the pixel third from left, the toner images of two colors that are the cyan toner 4C and the magenta toner 4M are primarily transferred onto intermediate transfer belt 131, and the toner quantity is toner density Dt=200%. At the rightmost pixel, the toner images of three colors that are the cyan toner 4C, the magenta toner 4M, and the yellow toner 4Y are primarily transferred onto intermediate transfer belt 131, and the toner quantity is toner density Dt=300%. Toner density Dt corresponds to a specific example of "developer density" in the invention, and the toner quantity corresponds to "developer quantity" in the invention.

Host I/F 250 illustrated in FIG. 3 is an I/F provided to receive print data D1 supplied from PC 9, and to supply them to internal bus 270. External I/F 260 is an I/F provided to connect CPU 210, ROM 220, RAM 230, timer 240, host I/F 250, and operation panel 280 in controller control section 200, to the outside (printing control section 300, paper sensors 124 and 161, density sensor 137, and environment sensor 100). Internal bus 270 is a bus provided to interconnect CPU 210, ROM 220, RAM 230, timer 240, host I/F 250, operation panel 280, and external I/F 260 in controller control section 200. Operation panel 280 is a touch panel (provided to receive various kinds of setting information input by operation of the user) on which various kinds of setting and the like in image formation apparatus 1 are to be performed.

(Printing Control Section 300)

As illustrated in FIG. 3, printing control section 300 has high-voltage controller 310, exposure controller 320, and motor controller 330. Of these, high-voltage controller 310 has feed-voltage controller 312, development-voltage controller 313, charge-voltage controller 314, and transfer controller 315.

Feed-voltage controller 312 controls a supply voltage for feed roller 114 in each of image formation sections 11C, 11M, 11Y, 11K, and 11CL. Development-voltage controller 313 controls a supply voltage for development roller 113 in each of image formation sections 11C, 11M, 11Y, 11K, and 11CL. Charge-voltage controller 314 controls a supply voltage for charge roller 112 in each of image formation sections 11C, 11M, 11Y, 11K, and 11CL. Transfer controller 315 controls each of a supply voltage (a primary transfer voltage) for transfer roller 133 and a supply voltage (secondary transfer voltage V2 described above) for secondary transfer roller 14.

Exposure controller 320 controls the operation (exposure operation) of exposure head 117 in each of image formation sections 11C, 11M, 11Y, 11K, and 11CL, based on post-correction print data D2 described above, which is supplied from controller control section 200. Motor controller 330 controls, for example, the operations of conveying print medium 120, driving rotation of each member in each of image formation sections 11C, 11M, 11Y, 11K, and 11CL, driving rotation of intermediate transfer belt 131, and the like.

Operations and Effects

A. Basic Operation of Entire Image Formation Apparatus 1

In image formation apparatus 1, an image (an image layer) is formed on print medium 120 as follows. For example, as illustrated in FIG. 3, first, controller control section 200 receives print data D1 (a print job) from an external device such as PC 9 via a communication line. Controller control section 200 and printing control section 300 then execute a print processing based on print data D1 such that each member in image formation apparatus 1 performs the following operation.

First, as illustrated in FIG. 1, print medium 120 contained in paper cassette 121 is conveyed to conveyance path d2 in the following way. Specifically, first, feed roller 122 extracts an uppermost print medium 120 one by one separately from the rest. Next, conveyance roller pairs 123*a* and 123*b* convey extracted print medium 120 on conveyance path d2 toward the secondary transfer roller 14 after correcting an oblique posture of print medium 120.

Meanwhile, based on print data D1 described above, image formation sections 11C, 11M, 11Y, 11K, and 11CL form the respective toner images of the respective colors by the following electrophotographic process.

First, charge roller 112 uniformly charges the surface (the outer layer part) of photosensitive drum 111. Then, exposure head 117 emits irradiation light to the surface of photosensitive drum 111, thereby performing exposure. As a result, an electrostatic latent image corresponding to a printing pattern is formed on photosensitive drum 111.

Meanwhile, feed roller 114 is in contact with development roller 113, and feed roller 114 and development roller 113 each rotate at a predetermined circumferential velocity. As a result, the toner is supplied from feed roller 114 to the surface of development roller 113.

Next, the toner on development roller 113 is charged by, for example, friction against a toner regulation member (not illustrated) in contact with development roller 113. Here, a thickness of the toner layer on development roller 113 is determined by a voltage applied to development roller 113, a voltage applied to feed roller 114, a pressure of the toner regulation member (a voltage applied to the above-described toner regulation member), and the like.

In addition, since development roller 113 and photosensitive drum 111 are in contact with each other, the toner on development roller 113 adheres to the electrostatic latent image on photosensitive drum 111 by applying a voltage to development roller 113.

Afterward, the toner (the toner image) on photosensitive drum 111 is transferred (primarily transferred) onto intermediate transfer belt 131 by an electric field of primary transfer roller 133 in intermediate transfer belt unit 13. The toner left on the surface of photosensitive drum 111 is scraped off by a cleaning blade (not illustrated) and then stored in a transfer-belt cleaner container (not illustrated), thereby being removed.

In this way, the toner image of the color is formed in each of image formation sections 11C, 11M, 11Y, 11K, and 11CL, and then primarily transferred onto intermediate transfer belt 131 sequentially in conveyance direction d1 described above.

Next, the toner image on intermediate transfer belt 131 is transferred (secondarily transferred) in the following way to print medium 120 conveyed on conveyance path d2 as described above. Specifically, intermediate transfer belt 131 and print medium 120 are conveyed to a position between secondary transfer roller 14 and backup roller 134 disposed within intermediate transfer belt unit 13 as illustrated in FIG. 1, and then predetermined secondary transfer voltage V2 is applied as illustrated in FIG. 2. As a result, the toner image on intermediate transfer belt 131 is secondarily transferred onto print medium 120.

Next, as illustrated in FIG. 1, fuser 15 applies heat and pressure to the toner on print medium 120 conveyed from the secondary transfer roller 14, so that the toner is fixed onto print medium 120. Specifically, the fixing operation is performed such that heat roller 151 and pressure roller 152 apply heat and pressure, respectively, to print medium 120 conveyed on conveyance path d2.

Print medium 120 thus subjected to the fixing operation is then ejected to the outside of image formation apparatus 1, via separator 162 and discharge roller pair 18 on conveyance path d3, as illustrated in FIG. 1. When, for example, double-sided printing is performed on print medium 120 (in the double-sided printing mode), the following operation is performed before print medium 120 is ejected to the outside. Specifically, print medium 120 is reversed by passing through separator 162 as well as inversion roller pair 172, conveyance roller pairs 173*a*, 173*b* and other components on conveyance path d4, and then returns to the upstream side of the conveyance roller pair 123*b* on conveyance path d2. The image formation operation in image formation apparatus 1 is thereby completed.

B. Problems in Conventional Transfer

Here, problems in the transfer (secondary transfer) in a conventional image formation apparatus are described with reference to FIGS. 7 and 8.

Figure 7:
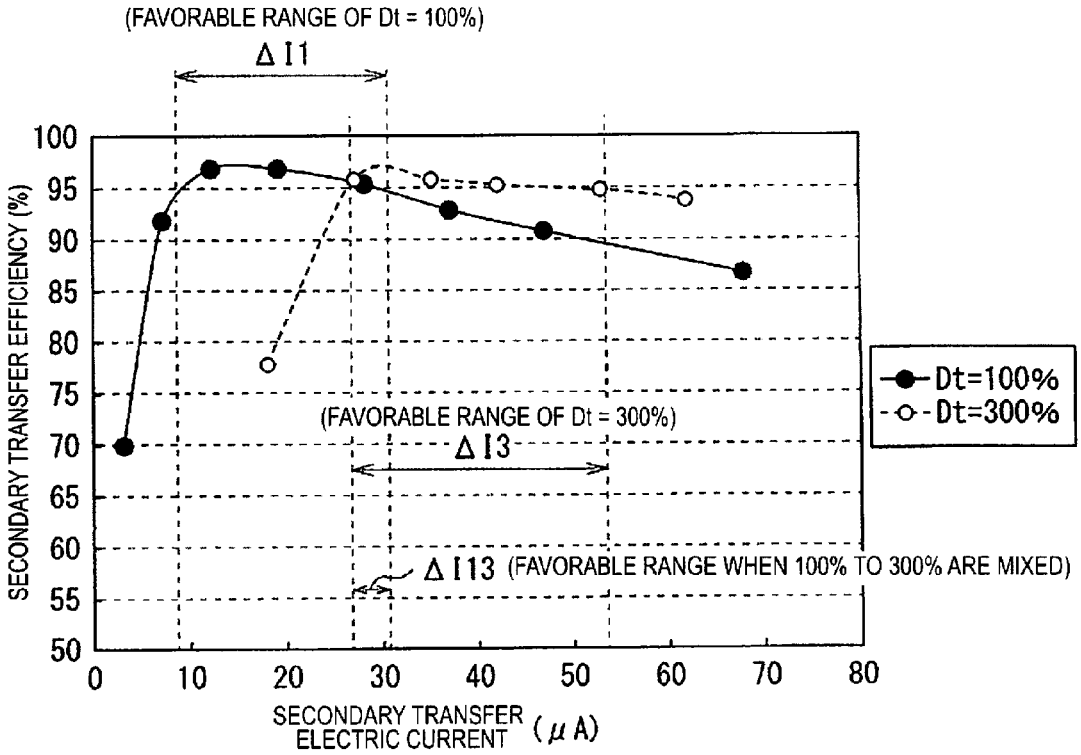
FIG. 7 is a diagram for describing secondary transfer efficiency in a general case.

FIG. 7 illustrates a general example of a correlation between a secondary transfer electric current and a secondary transfer efficiency in a normal print environment (NN; a temperature is about 25° C., and a humidity is about 50%). In addition, FIG. 7 illustrates ranges (ΔI1 and ΔI3) of the secondary transfer electric current in which the secondary transfer efficiency is favorable (95% or more), for each of a case where toner density Dt=100% (the number of toner colors is one) and a case where toner density Dt=300% (the number of toner colors is three).

As illustrated in FIG. 7, in both of the cases where toner density Dt=100% and 300%, when the secondary transfer electric current becomes small, the secondary transfer efficiency sharply drops for the following reason. The lack of a secondary transfer electric current makes the secondary transfer insufficient, causing "blurring". As a result, the ratio of the toner left on intermediate transfer belt 131 increases. On the other hand, in both of the cases where toner density Dt=100% and 300%, as the secondary transfer electric current becomes larger, the secondary transfer efficiency gradually decreases for the following reason. An excessive secondary transfer electric current causes a phenomenon referred to as "scattering" in which the toner in the secondary transfer is partly lost, and also causes "blurring" accompanied by an electric discharge.

In FIG. 7, range ΔI1 in which the secondary transfer efficiency is favorable when toner density Dt=100% is a range in which the secondary transfer electric current is about 9 to 30 μA. Range ΔI3 in which the secondary transfer efficiency is favorable when toner density Dt=300% is a range in which the secondary transfer electric current is about 26 to 52 μA. Therefore, assuming that the distribution of toner density Dt on print medium 120 is within a range of 100% to 300%, the secondary transfer electric current needs to be set in a range (favorable range ΔI13) where favorable ranges ΔI1 and ΔI3 overlap each other, which is an extremely narrow range (26 to 30 μA). However, the distribution of toner density Dt may not fall within the range of 100% to 300%. In addition, for example, at the time of printing a second side in a double-sided printing mode, or in a low-temperature low-humidity environment, this favorable range ΔI13 may become even narrower, because moisture contained in print medium 120 is reduced. Therefore, in some cases, the range of the secondary transfer electric current in which favorable ranges ΔI1 and ΔI3 overlap each other may be a range where the secondary transfer efficiency is 90% or less.

Figure 8:
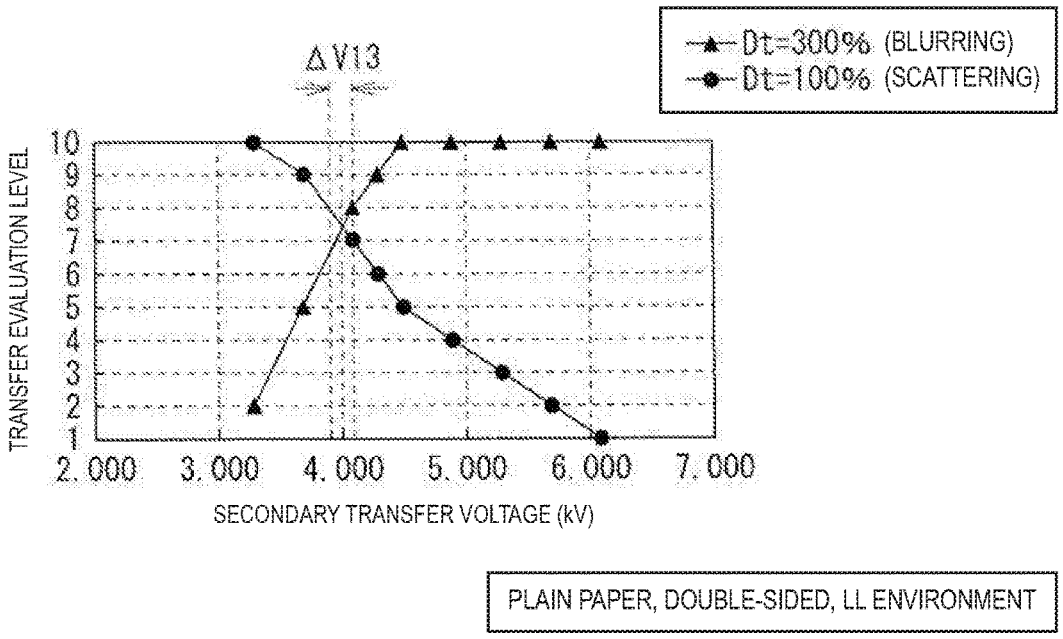
Fig. 8 PRIOR ART
FIG. 8 is a diagram illustrating an example of a correlation between a secondary transfer voltage and a transfer evaluation level, in a conventional case.

FIG. 8 illustrates an example of a correlation between secondary transfer voltage V2 and a transfer evaluation level in a conventional image formation apparatus. In this conventional example illustrated in FIG. 8, the type of print media is the plain paper, the print mode is the double-sided printing mode, and the print environment is the low-temperature low-humidity environment (LL). In addition, in FIG. 8, the transfer evaluation level is expressed by a "scattering" occurrence level when toner density Dt=100% (the number of toner colors is one) and a "blurring" occurrence level when toner density Dt=300% (the number of toner colors is three). This transfer evaluation level is expressed by ten levels, and a level 10 indicates the most favorable transfer.

As illustrated in FIG. 8, in the double-sided printing mode and the low-temperature low-humidity environment described above, range ΔV13 of secondary transfer voltage V2, which can ensure a favorable transfer evaluation level (for example, a level 7 or higher) in both of the cases where toner density Dt=100% and 300%, is extremely small.

In this way, in the conventional image formation apparatus, a defect such as "scattering" and "blurring" described above increases during the transfer (secondary transfer), due to distribution variation, printing conditions, and the like. As a result, it is difficult to achieve a favorable image quality (to improve the image quality).

C. Image Formation Operation of the Embodiment

Image formation apparatus 1 of the embodiment addresses the above-described conventional problems by performing the image formation operation to be described below.

FIG. 9 illustrates an example of the image formation operation of the embodiment with a flowchart. FIG. 10 is a schematic cross-sectional diagram for describing the image formation operation illustrated in FIG. 9.

Before the image formation operation to be described below, the above-described density correction (the exposure control to achieve a toner layer thickness target) is performed. Specifically, density sensor 137 detects a layer thickness of the toner primarily transferred onto intermediate transfer belt 131, and the exposure control is performed to achieve a toner layer thickness target (toner quantity when toner density Dt=100%) based on the detection value obtained thereby.

In this example of the image formation operation, at first, controller control section 200 in image formation apparatus 1 receives print data D1 from PC 9 (step S11 of FIG. 9). Next, controller control section 200 determines the above-described various parameters, based on the type of print media set in operation panel 280 beforehand by the user, the type of print media specified in received print data D1, a detection value obtained by environment sensor 100, and the like (step S12). Specifically, in this example, controller control section 200 determines the type of print media, the print mode (such as the single-sided printing mode, and the first side or the second side of the double-sided printing mode), the print environment, and the number of toner colors.

Next, based on received print data D1, CPU 210 in controller control section 200 calculates toner density Dt of each pixel (toner density distribution M) to be primarily transferred to intermediate transfer belt 131, as schematically illustrated in Part (A) of FIG. 10, for example (step S13). In this process, when performing image formation using the toners of multiple colors, CPU 210 calculates toner density Dt of each pixel by using the total quantity of the toners of the multiple colors as the toner quantity, as illustrated in FIG. 6 described above and in Part (A) of FIG. 10. Toner density distribution M corresponds to a specific example of "distribution of developer density" in the invention.

Next, according to toner density distribution M thus calculated, CPU 210 corrects print data D1 such that, together with the toner image of each color to be formed based on print data D1, the above-described low chroma toner image (in this example, the transparent toner image) is additionally transferred (primarily transferred) to intermediate transfer belt 131 in the image formation. In other words, based on calculated toner density distribution M, CPU 210 creates print data for forming such a transparent toner image.

Specifically, at first, using toner-density lower limit setting table T2 stored in ROM 220, which is illustrated in FIG. 5, for example, CPU 210 compares lower limit ThL which corresponds to the condition of the above-described parameters determined in step S12, with calculated toner density Dt of each pixel (step S14, see Part (A) of FIG. 10).

Next, CPU 210 corrects print data D1 in each pixel in a manner illustrated in Part (A) and Part (B) of FIG. 10 for example (step S15). In other words, CPU 210 corrects print data D1 in a pixel where toner density Dt is less than lower limit ThL (Dt<ThL), and does not correct print data D1 in a pixel where toner density Dt is equal to or greater than lower limit ThL (Dt ThL). In this process, specifically, as illustrated in Part (B) of FIG. 10, CPU 210 corrects print data D1 by setting an additional quantity of the low chroma toner (in this example, the transparent toner) in a pixel of (Dt<ThL) to achieve (Dt≥ThL). In this example, as illustrated in Part (B) of FIG. 10, print data D1 is corrected to achieve (Dt=ThL) so that the additional quantity of the transparent toner is a minimum.

Here, in this example, using the foregoing toner-density lower limit setting table T2 for correcting print data D1 makes it possible to set an appropriate lower limit ThL corresponding to the above-described various conditions. Accordingly, this makes it possible to appropriately adjust the additional quantity of the transparent toner to minimize toner consumption. In addition, using a table set beforehand reduces a processing burden on CPU 210 in performing a correction.

Next, in each of image formation sections 11C, 11M, 11Y, 11K, and 11CL, image formation is performed for print medium 120 based on print data D2 resulting from the above-described correction (step S16). In other words, printing control section 300 performs print control such that image formation operation is performed in each of image formation sections 11C, 11M, 11Y, 11K, and 11CL, based on post-correction print data D2 supplied from controller control section 200.

Specifically, first, based on print data D2, toner images (color toner images and a low chroma toner image) of the respective colors formed by respective image formation sections 11C, 11M, 11Y, 11K, and 11CL are primarily transferred onto intermediate transfer belt 131 (step S161).

Next, secondary transfer voltage V2 corresponding to the condition of each of the above-described parameters determined in step S12 is set, using secondary-transfer voltage setting table T1 stored in ROM 220, which is illustrated in FIG. 4, for example (step S162). Using the thus-set secondary transfer voltage V2, the toner image of each color (the color toner images and the low chroma toner image) on intermediate transfer belt 131 is secondarily transferred onto print medium 120, as schematically illustrated in Part (C) of FIG. 10, for example (step S163).

In this way, secondary transfer voltage V2 is changed according to, for example, at least one of the type of print media, the print mode, the print environment, and the number of toner colors. Therefore, appropriate secondary transfer voltage V2 corresponding to such various printing conditions can be set.

Afterward, the above-described fixing operation is performed for the toner image of each color secondarily transferred onto print medium 120 (step S164). This completes the series of steps in the image formation operation illustrated in FIG. 9.

In the embodiment, toner density distribution M is calculated based on print data D1, and according to calculated toner density distribution M, print data D1 is corrected such that, together with the toner image to be formed based on print data D1, the low chroma toner image (the transparent toner image) is additionally primarily transferred to intermediate transfer belt 131 in the image formation. Therefore, in the image formation based on print data D2 after such a correction, toner density Dt is increased by adding the low chroma toner image, so that variation of toner density distribution M is suppressed.

D. Examples

Here, specific examples (Examples 1 to 3) in the embodiment are described with reference to FIGS. 11A, 11B, and 11C.

Figure 11A:
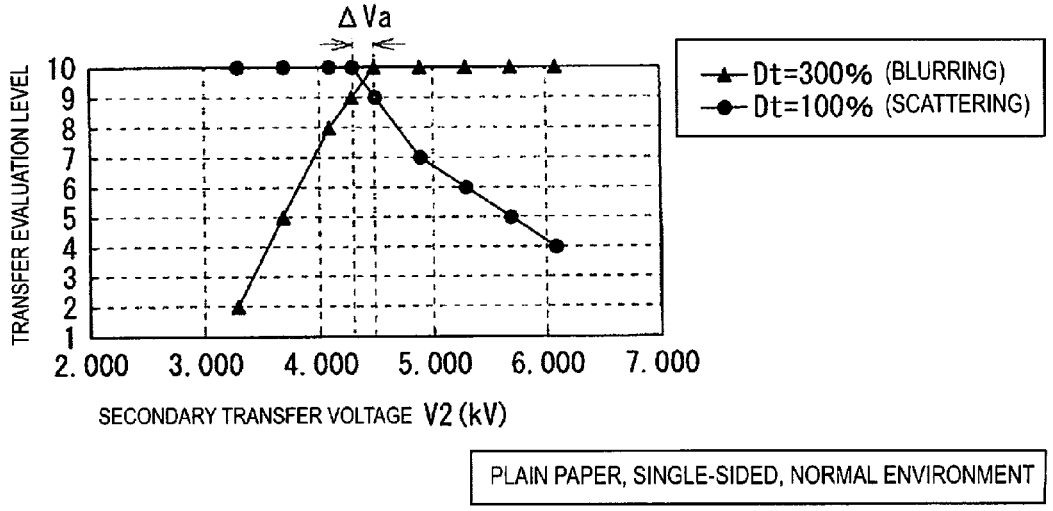
FIG. 11A is a diagram illustrating a correlation between a secondary transfer voltage and a transfer evaluation level according to Example 1.
Figure 11B:
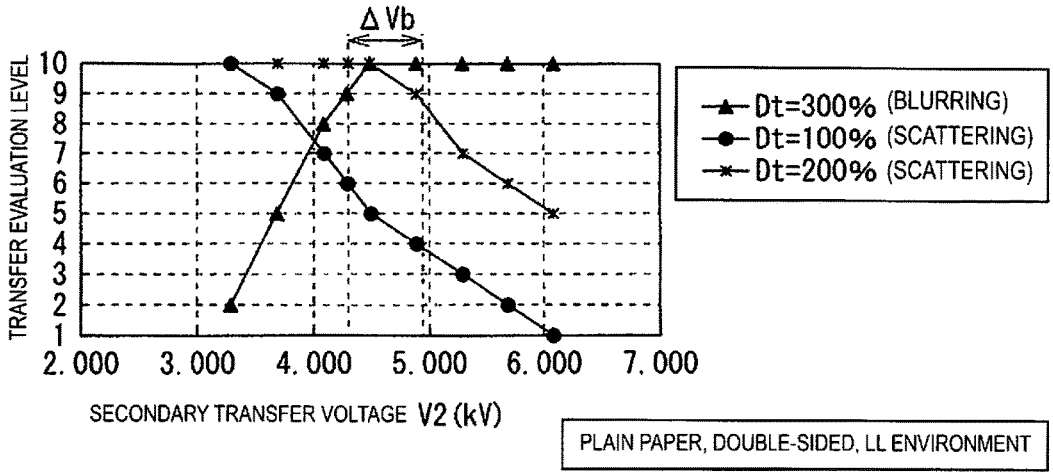
FIG. 11B is a diagram illustrating a correlation between a secondary transfer voltage and a transfer evaluation level according to Example 2.

FIG. 11A illustrates a correlation between secondary transfer voltage V2 and a transfer evaluation level according to Example 1, and FIG. 11B illustrates a correlation between secondary transfer voltage V2 and a transfer evaluation level according to Example 2. FIG. 11C illustrates a correlation between secondary transfer voltage V2 and a transfer evaluation level according to Example 3.

(Example 1)

First, in Example 1 illustrated in FIG. 11A, the type of print media is the plain paper, the print mode is the single-sided printing mode, and the print environment is the normal environment (NN). In Example 1, the transfer evaluation level is expressed by a "scattering" occurrence level when toner density Dt=100% (the number of toner colors is one) and a "blurring" occurrence level when toner density Dt=300% (the number of toner colors is three). As illustrated in FIG. 11A, range ΔVa of secondary transfer voltage V2, which indicates a favorable transfer evaluation level (a level 9 or higher) in both of the cases where toner density Dt=100% and 300%, can be secured in Example 1.

(Example 2)

Next, in Example 2 illustrated in FIG. 11B, the type of print media is the plain paper, the print mode is the double-sided printing mode, and the print environment is the low-temperature low-humidity environment (LL). In Example 2, the transfer evaluation level is expressed by a "scattering" occurrence level when toner density Dt=100% (the number of toner colors is one), a "scattering" occurrence level when toner density Dt=200% (the number of toner colors is two), and a "blurring" occurrence level when toner density Dt=300% (the number of toner colors is three). As illustrated in FIG. 11B, range ΔVb of secondary transfer voltage V2, which indicates a favorable transfer evaluation level (a level 9 or higher) in both of the cases where toner density Dt=200% and 300%, can be secured in Example 2.

(Example 3)

Figure 11C:
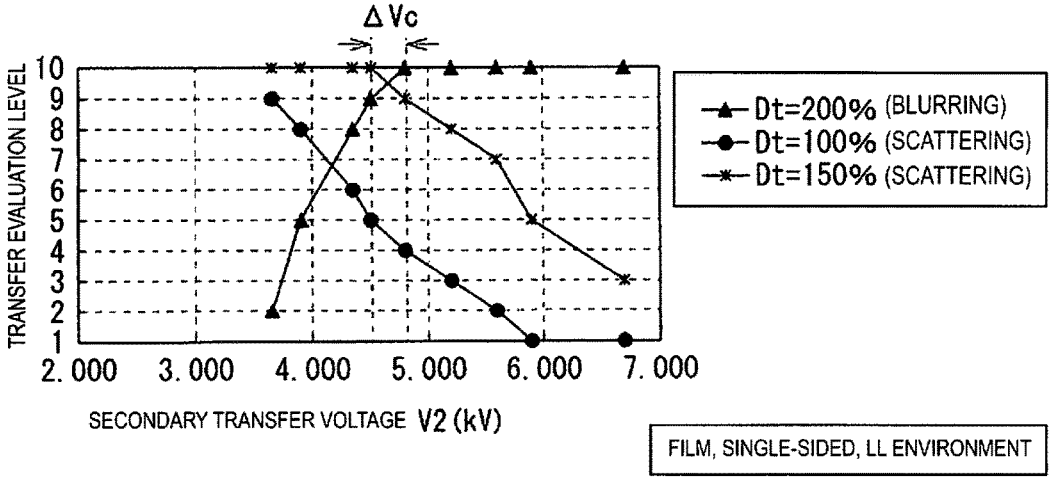
FIG. 11C is a diagram illustrating a correlation between a secondary transfer voltage and a transfer evaluation level according to Example 3.

In Example 3 illustrated in FIG. 11C, the type of print media is the film, the print mode is the single-sided printing mode, and the print environment is the low-temperature low-humidity environment (LL). In Example 3, the transfer evaluation level is expressed by a "scattering" occurrence level when toner density Dt=100% (the number of toner colors is one), a "scattering" occurrence level when toner density Dt=150% (the number of toner colors is two), and a "blurring" occurrence level when toner density Dt=200% (the number of toner colors is two). As illustrated in FIG. 11C, range ΔVc of secondary transfer voltage V2, which indicates a favorable transfer evaluation level (a level 9 or higher) in both of the cases where toner density Dt=150% and 200%, can be secured in Example 3.

As described above, in the embodiment, toner density distribution M is calculated based on print data D1, and according to calculated toner density distribution M, print data D1 is corrected such that, together with the toner image to be formed based on print data D1, the low chroma toner image (the transparent toner image) is additionally primarily transferred to intermediate transfer belt 131 in the image formation. Therefore, in the image formation based on print data D2 after such a correction, a low value of toner density Dt is increased by adding the low chroma toner image, so that variation of toner density distribution M is suppressed. Accordingly, during the transfer (secondary transfer) in the image formation, the above-described defects such as "scattering" and "blurring" due to distribution variation can be suppressed, and this makes it possible to achieve a favorable image quality (to improve the image quality)

In addition, the following effect is also achievable because the transfer voltage (secondary transfer voltage V2) in the image formation is changed according to at least one of the type of print media 120, the print mode, the print environment, and the number of toner colors. Appropriate secondary transfer voltage V2 corresponding to such various printing conditions can be set, so that transfer in special printing conditions (for example, printing of the second side in the double-sided printing mode, the low-temperature low-humidity environment, high-resistance media such as film, and the like) can also be appropriately performed.

2. Modification

Next, a modification of the embodiment is described. The same components as those in this modification are provided with the same reference characters as those in the embodiment, and therefore, the description thereof is omitted as appropriate.

Figure 12:
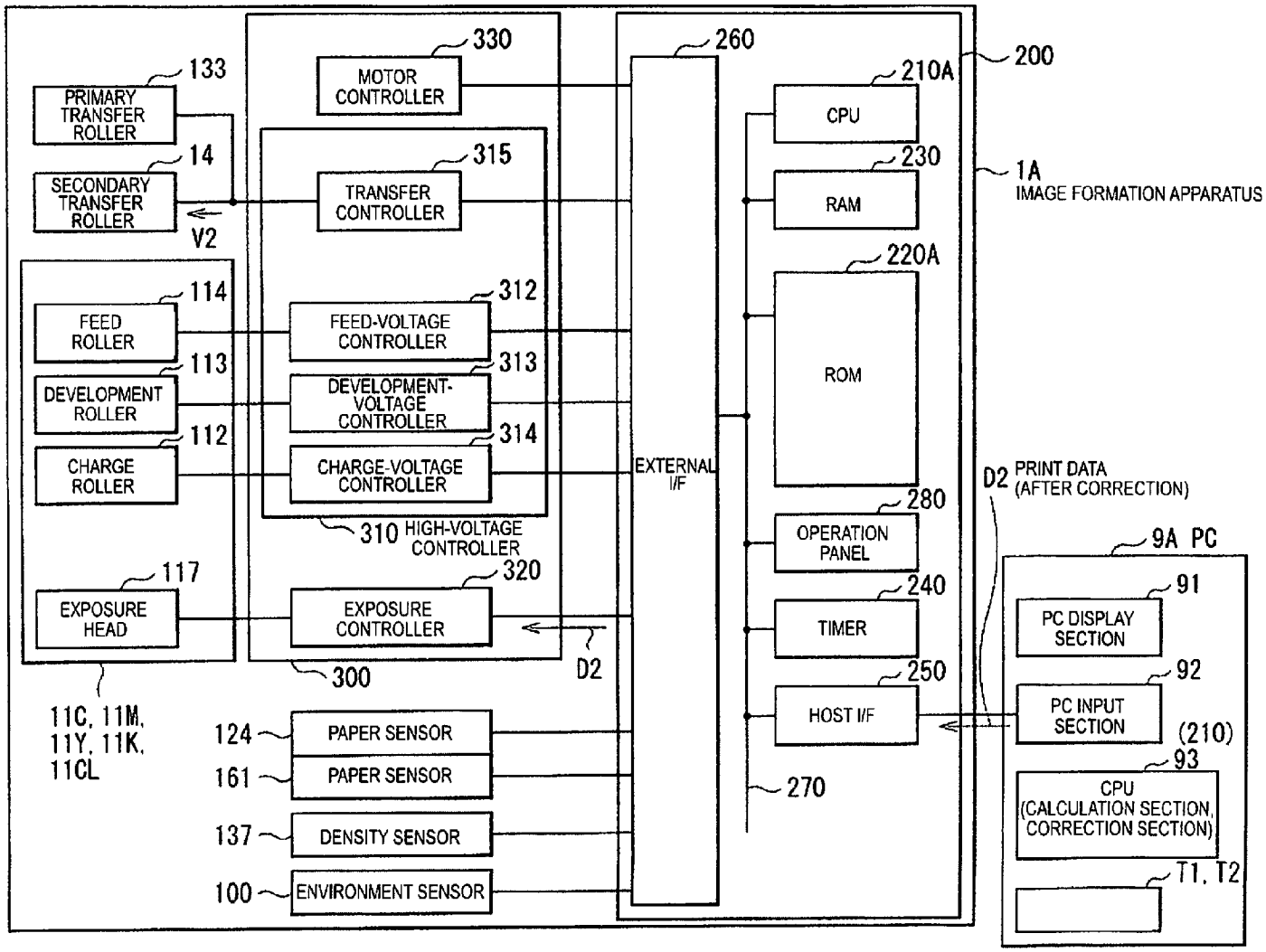
FIG. 12 is a diagram illustrating a block configuration example of an image formation apparatus and an image processing apparatus according to a modification.

FIG. 12 illustrates a block configuration example including an image formation apparatus (image formation apparatus 1A) and an external device (PC 9A) according to the modification. An image formation method according to the modification is embodied in image formation apparatus 1A and PC 9A of the modification, and therefore is described below together therewith.

As illustrated in FIG. 12, image formation apparatus 1A of the modification is configured by replacing CPU 210 and ROM 220 in image formation apparatus 1 of the above-described embodiment with CPU 210A and ROM 220A, respectively. PC 9A of the modification is configured by providing PC 9 of the above-described embodiment with CPU 93, secondary-transfer voltage setting table T1, and toner-density lower limit setting table T2. Other configurations of the modification are basically similar to the configurations of the above-described embodiment.

CPU 210A corresponds to CPU 210 without (not including) the functions (such as the calculation function of determining toner density distribution M and the correction function of correcting print data D1) described in the embodiment. Further, ROM 220A corresponds to ROM 220 not storing (not holding) secondary-transfer voltage setting table T1 and toner-density lower limit setting table T2.

Meanwhile, CPU 93 corresponds to a CPU having functions similar to the functions (such as the calculation function of determining toner density distribution M and the correction function of correcting print data D1) of CPU 210. In other words, CPU 93 corresponds to a specific example of each of "calculation section", "correction section", and "image processing apparatus" in the invention.

As in the modification, "image processing apparatus" in the invention may be provided outside the image formation apparatus (in this example, image formation apparatus 1A). In other words, for example, as illustrated in FIG. 12, image formation may be performed in image formation apparatus 1A based on print data D2 after the correction described in the embodiment is performed in PC 9A. Such a configuration makes it possible for the modification to obtain effects similar to the effects of the embodiment, while using as image formation apparatus 1A an image formation apparatus with a conventional configuration as it is (that is, not having the functions described above in the embodiment).

3. Other Modifications

The invention is described above using the embodiment and the modification, but the invention is not limited to this embodiment and modification and may be variously modified.

For example, in the embodiment and the like, the configuration (shape, arrangement, number, and the like) of each member in the image formation apparatus is specifically described. However, such a configuration in each member is not limited to the configuration described in the embodiment, and another shape, arrangement, number, and the like may be adopted. In addition, the values of the respective various parameters, the relationship in magnitude, and the like described in the embodiment are also not limited to those described in the embodiment, and it is possible to perform a control with other values and relationship in magnitude.

Further, in the embodiment and the like, "transparent-developer image" (transparent developer) is described as an example of a "low chroma developer image" (low chroma developer) in the invention, but the invention is not limited to this example. A developer image of any other color may be used, if the developer image is lower in chroma than the developer image of each color to be formed based on the original print data. In other words, for example, "white developer image" (white developer) may be used for a "low chroma developer image" (low chroma developer). Examples of a coloring agent to be used for this white developer include a pigment having a large specific gravity such as metal oxide (such as titanium oxide and zinc oxide) generally used as a white pigment. The color in such "low chroma developer image" (low chroma developer) is set, for example, depending on the purpose and application of use. Specifically, for example, when a print medium is a transparent medium (such as film), it may be said that using a transparent-developer image (a transparent developer) is generally desirable.

Furthermore, in the embodiment and the like, the case where the unit region in calculating the toner density is a pixel is described as an example. However, the invention is not limited to this example. For example, the toner density may be calculated by using anything other than a pixel as the unit region.

In addition, in the embodiment and the like, setting each of secondary transfer voltage V2 and toner-density lower limit ThL by using predetermined tables (secondary-transfer voltage setting table T1 and toner-density lower limit setting table T2) is described as an example, but the invention is not limited to this technique. In other words, for example, secondary transfer voltage V2 and toner-density lower limit ThL may each be determined whenever necessary, by using a predetermined calculation formula or the like. In this case, a coefficient and the like in the calculation formula may be stored in a ROM in an image formation apparatus.

Moreover, in the embodiment and the like, the image formation apparatus employing the so-called intermediate-transfer-type image formation apparatus is described as an example, but the invention is not limited to this example. In other words, the invention is also applicable to a so-called direct-transfer-type image formation apparatus, which directly transfers a toner image to a print medium with no intermediate transfer belt unit interposed therebetween.

Further, in the embodiment and the like, the case where the image formation sections (five image formation sections 11C, 11M, 11Y, 11K, and 11CL) are provided is described as an example, but the invention is not limited to this example. In other words, the number of image formation sections forming a toner image (an image layer), a combination of colors of toners to be used for these sections, a formation order of a toner image of each color (an arrangement order of the image formation sections), and the like may be freely set according to a use or purpose. In some cases, only one image formation section may be provided to use a monochrome (single color) image as a toner image. In other words, the image formation apparatus may function as a monochrome printer. Even in such a case, an image formation section that forms a low chroma toner image is separately provided in the invention.

In addition, in the embodiment and the like, the plain paper and the film are described as examples of the print medium, but the invention is not limited to these examples, and other type of media may be used as a recording medium. Specifically, for example, special media such as an overhead projector (OHP) sheet, a card, a postcard, a cardboard (having, for example, a basis weight of 250 g/m$^2$ or more), an envelope, and a coated paper having a large heat capacity may be used.

Moreover, in the embodiment and the like, the image formation apparatus functioning as a printer is described as a specific example of "image formation apparatus" in the invention, but the invention is not limited to this example. In other words, for example, the invention is also applicable to an image formation apparatus functioning as any of a facsimile, a copier, a multifunction printer, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

a calculation section which calculates, based on print data, a distribution of a developer density that is a developer quantity per unit region to be transferred to a transfer object in an image formation;

a correction section which performs a correction of the print data, according to the distribution of the developer density calculated by the calculation section, to additionally transfer a low chroma developer image to the transfer object in the image formation together with a developer image to be formed based on the print data, wherein chroma of the low chroma developer image is lower than chroma of the developer image based on the print data; and an image formation section which performs the image formation based on the print data after the correction performed by the correction section, wherein the correction section performs a correction of the print data in a unit region where the developer density is less than a lower limit, and performs no correction of the print data in a unit region where the developer density is equal to or greater than the lower limit.

2. The image formation apparatus according to claim 1, wherein the correction section performs a correction of the print data in the unit region where the developer density is less than the lower limit, by setting an additional quantity of a low chroma developer in the low chroma developer image to achieve the developer density equal to or greater than the lower limit.

3. The image formation apparatus according to claim 1, wherein the lower limit is a variable value.

4. The image formation apparatus according to claim 3, wherein the lower limit is changeable according to at least one of a type of print media, a print mode, a print environment, and a number of developer colors used in the image formation.

5. The image formation apparatus according to claim 4, wherein the lower limit when the type of print media is film is greater than the lower limit when the type of print media is plain paper.

6. The image formation apparatus according to claim 4, wherein the lower limit when the print mode is a double-sided printing mode is greater than the lower limit when the print mode is a single-sided printing mode.

7. The image formation apparatus according to claim 4, wherein the lower limit when the print environment is a low-temperature low-humidity environment is greater than the lower limit when the print environment is a normal environment.

8. The image formation apparatus according to claim 4, wherein the lower limit increases as the number of developer colors increases.

9. The image formation apparatus according to claim 4, wherein the correction section performs a correction of the print data by using a table defining a correlation between the lower limit and at least one of the type of print media, the print mode, the print environment, and the number of developer colors.

10. The image formation apparatus according to claim 1, wherein the image formation section performs the image formation by using developers of colors, and wherein the calculation section calculates a distribution of the developer density by using a total quantity of the developers of the colors as the developer quantity.

11. The image formation apparatus according to claim 1, wherein the image formation section changes a transfer voltage in the image formation according to at least one of a type of print media, a print mode, a print environment, and the number of developer colors used in the image formation.

12. The image formation apparatus according to claim 1, wherein the low chroma developer image is one from the group of a transparent-developer image and a white developer image.

13. The image formation apparatus according to claim 1, wherein the unit region is a pixel.

14. The image formation apparatus according to claim 1, wherein the image formation section performs the image formation on a print medium by performing secondary transfer to the print medium via an intermediate transfer belt subjected to a primary transfer as the transfer object.

15. An image processing apparatus comprising:

a calculation section which calculates, based on print data, a distribution of a developer density that is a developer quantity per unit region to be transferred to a transfer object in an image formation; and a correction section which performs a correction of the print data according to the distribution of the developer density calculated by the calculation section to additionally transfer a low chroma developer image to the transfer object in the image formation together with a developer image to be formed based on the print data, chroma of the low chroma developer image being lower than chroma of the developer image based on the print data, wherein the correction section performs a correction of the print data in a unit region where the developer density is less than a lower limit, and performs no correction of the print data in a unit region where the developer density is equal to or greater than the lower limit.

16. An image formation method comprising:

calculating, based on print data, a distribution of a developer density that is a developer quantity per unit region to be transferred to a transfer object in an image formation;

performing a correction of the print data according to the distribution of the developer density calculated to additionally transfer a low chroma developer image to the transfer object in the image formation together with a developer image to be formed based on the print data, chroma of the low chroma developer image being lower than chroma of the developer image based on the print data; and performing the image formation based on the print data after the correction performed by the correction section, wherein the performing the correction of the print data comprises:

performing a correction of the print data in a unit region where the developer density is less than a lower limit; and performing no correction of the print data in a unit region where the developer density is equal to or greater than the lower limit.

* * * * *